US009444155B2

(12) United States Patent
Chen et al.

(10) Patent No.: US 9,444,155 B2
(45) Date of Patent: Sep. 13, 2016

(54) TERMINAL CONNECTOR WITH IMPROVED ACTUATION STRUCTURE

(71) Applicant: TARNG YU ENTERPRISE CO., LTD., New Taipei (TW)

(72) Inventors: Tsung-Chi Chen, New Taipei (TW); Mu-Jung Huang, New Taipei (TW)

(73) Assignee: TARNG YU ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 14/726,213

(22) Filed: May 29, 2015

(65) Prior Publication Data

US 2015/0357728 A1 Dec. 10, 2015

(30) Foreign Application Priority Data

Jun. 10, 2014 (TW) ..... 103120088 A

(51) Int. Cl.

| | |
|---|---|
| ***H01R 4/28*** | (2006.01) |
| ***H01R 4/48*** | (2006.01) |
| *H01R 4/50* | (2006.01) |
| *H01R 12/51* | (2011.01) |

(52) U.S. Cl.

CPC ..... *H01R 4/48* (2013.01); *H01R 4/4845* (2013.01); *H01R 4/5083* (2013.01); *H01R 12/515* (2013.01)

(58) Field of Classification Search

CPC .. H01R 4/4836; H01R 4/4845; H01R 4/489; H01R 4/48; H01R 4/4809; H01R 4/881

USPC ..... 439/725, 852, 438, 437, 441, 835

See application file for complete search history.

(56) References Cited

U.S. PATENT DOCUMENTS

| | | | | |
|---|---|---|---|---|
| 7,431,603 | B1 * | 10/2008 | Szmidt | H01R 4/4836 439/289 |
| 7,513,793 | B2 * | 4/2009 | Horst | H01R 4/4818 439/427 |
| 8,113,858 | B1 * | 2/2012 | Chiang | H01R 4/4845 439/188 |
| 8,328,586 | B2 * | 12/2012 | Bies | H01R 12/53 439/725 |
| 8,591,271 | B2 * | 11/2013 | Bies | H01R 4/4836 439/725 |
| 8,882,533 | B2 * | 11/2014 | Brandberg | H01R 13/193 439/441 |
| 8,968,022 | B2 * | 3/2015 | Mostoller | H01R 4/4836 439/438 |
| 2014/0242833 | A1 * | 8/2014 | Mostoller | H01R 4/4836 439/438 |

* cited by examiner

*Primary Examiner* — Hae Moon Hyeon

(74) *Attorney, Agent, or Firm* — Muncy, Geissler, Olds & Lowe, P.C.

(57) ABSTRACT

A terminal connector includes a housing, at least one conductor-retaining terminal each including an insertion passage for receiving the conductor of one respective electrical wire inserted into the housing and two springy suspension arms bilaterally disposed near a rear side and respectively curving toward the inside of the insertion passage for clamping the conductor, and at least one slide block each including a sliding cover panel coupled to the housing two beveled pushing surfaces located at a bottom side of the sliding cover panel and movable with the sliding cover panel between a first position where the pushing surfaces are kept away from the springy suspension arms for allowing the springy suspension arms to clamp on the conductor and a second position where the pushing surfaces are engaged into the gap between the springy suspension arms to release the conductor from the constraint of the springy suspension arms.

10 Claims, 12 Drawing Sheets

TERMINAL CONNECTOR WITH IMPROVED ACTUATION STRUCTURE

BACKGROUND OF THE INVENTION

1. Field of the Invention

The present invention relates to electrical connector technology and more particularly, to a terminal connector, which uses at least one conductor-retaining terminal for clamping the conductors of two electrical wires respectively, and at least one slide block respectively slidable into or away from the conductor-retaining terminal, causing two springy suspension arms of each conductor-retaining terminal to clamp or release the conductor of one respective inserted electrical wire.

2. Description of the Related Art

With fast development of computer and electronics technology, various electronic products have been created and widely used in every corner of the society. However, with fast development of advanced technology, it is the market trend to create computers and electronic products having strong operational capabilities and high operational speed and the characteristics of light, thin, short, small. In consequence, the size and height of electrical connectors for use in a computer or electronic product need to be greatly reduced in response to this development trend. In contrast, the bonding of an electrical connector with electrical wires of conducting terminals on a circuit board or motherboard and there will become more difficult.

Regular terminal connectors are generally directly bonded to the circuit board or motherboard. A terminal connector generally comprises an electrically insulative housing, one or a number of conductor-retaining terminal made by conducting metal, and an actuation button. When an electrical wire or conducting terminal is inserted through the housing into a clamping hole in a front end of one respective conductor-retaining terminal, the inserted electrical wire or conducting terminal is then secured by and electrically conducted with the respective conductor-retaining terminal. When the user presses the actuation button at the top side of the housing, the clamping hole of each conductor-retaining terminal is stretched open, allowing removal of each electrical wire or conducting terminal out of the respective conductor-retaining terminal and the housing. Thus, this design of terminal connector achieves the functions of rapid plug and play and repeatable maintenance. However, this press button design needs to provide a certain amount of vertical space for the stroke of the actuation button so that the actuation button can be pressed to stretch open the clamping hole of each conductor-retaining terminal. In consequence, the overall height of the terminal connector will be relatively increased, and its structural design will be relatively complicated.

But in today's society, under the trend of consumers' mad pursuit of electronics products having light, thin, short and small characteristics, any connector dimensional reduction can affect the dimension and height of electronic products, causing a change in the circuit layout of the circuit board or motherboard. Further, there is a gap left between the actuation button and the housing, and external dust, objects and moisture can easily go through the gap into the inside of the housing to affect the normal functioning and lifespan of the terminal connector. Therefore, there is a strong demand for a measure that eliminates the drawbacks and disadvantages of the aforesaid prior design.

SUMMARY OF THE INVENTION

The present invention has been accomplished under the circumstances in view. It is therefore the main object of the present invention to provide a terminal connector with improved actuation structure, which provides a horizontally slidable slide block for controlling one respective conductor-retaining terminal to clamp or release the respective inserted electrical wire, wherein each slide block has a bottom push block with beveled pushing surfaces and is horizontally slidable relative to the housing of the terminal connector between a first position where the beveled pushing surfaces of the bottom push block of the slide block are kept away from two springy suspension arms of the conductor-retaining terminal and the two springy suspension arms of the conductor-retaining terminal are clamped on the conductor of the respective inserted electrical wire, and a second position where the beveled pushing surfaces of the bottom push block of the slide block are inserted into the gap in between the two springy suspension arms of the conductor-retaining terminal and the two springy suspension arms of the conductor-retaining terminal are released from the conductor of the respective inserted electrical wire for allowing removal of the respective inserted electrical wire out of the housing.

Preferably, each conductor-retaining terminal further comprises two side panels respectively formed integral with respective front ends of the two springy suspension arms, an insertion passage surrounded by the side panels for the insertion of the conductor of one respective electrical wire, a shrapnel and clamping portion respectively extended from respective distal ends of the springy suspension arms remote from the side panels and curved toward the inside of the insertion passage and disposed at different elevations. When the beveled pushing surfaces of the push block of the slide block are horizontally inserted into the gap between the two shrapnels, the two shrapnels are forced to curve outwards, and the two clamping portions are elastically outwardly deformed to release the conductor of the inserted electrical wire, allowing removal of the inserted electrical wire out of the housing. This design allows the user to move the push block in curving the shrapnels and the clamping portions conveniently with less effort, and the shrapnels, and thus, the clamping portions can be accurately pushed to release their clamping force from the conductor of the respective electrical wire.

DETAILED DESCRIPTION OF THE PREFERRED EMBODIMENT

Figure 1:
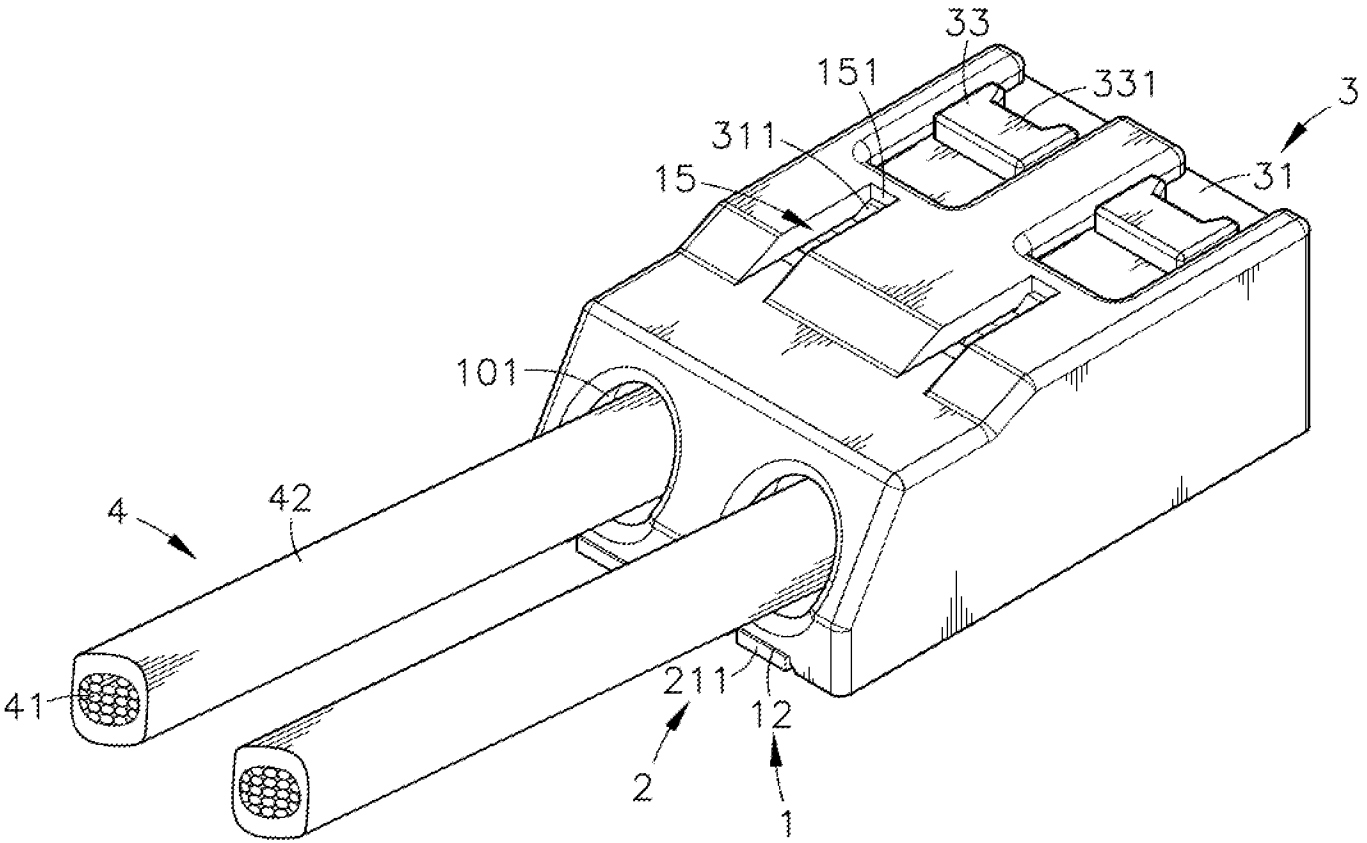
FIG. 1 is an oblique top elevational view of a terminal connector in accordance with the present invention.
Figure 2:
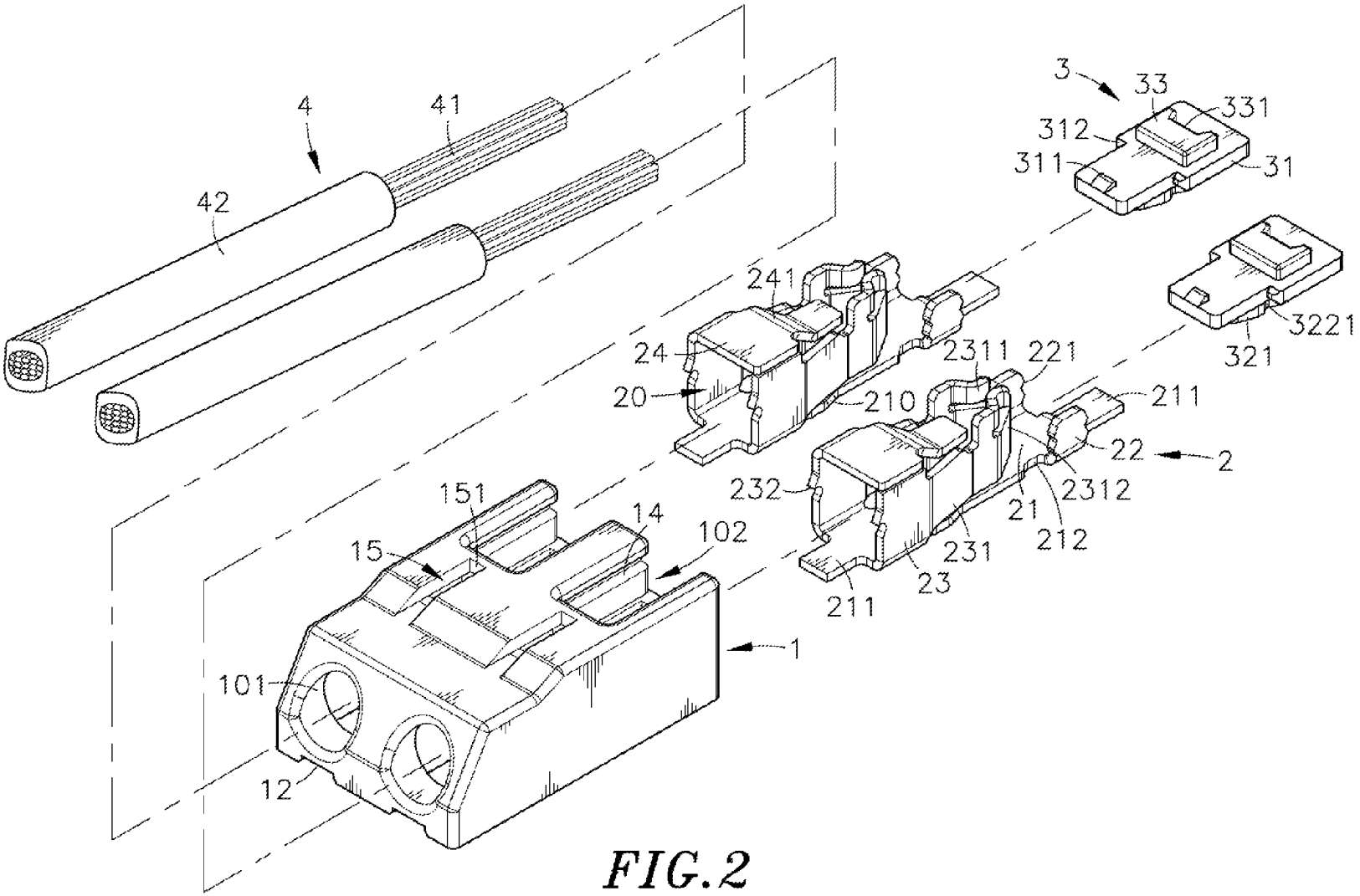
FIG. 2 is an exploded view of the terminal connector in accordance with the present invention.
Figure 3:
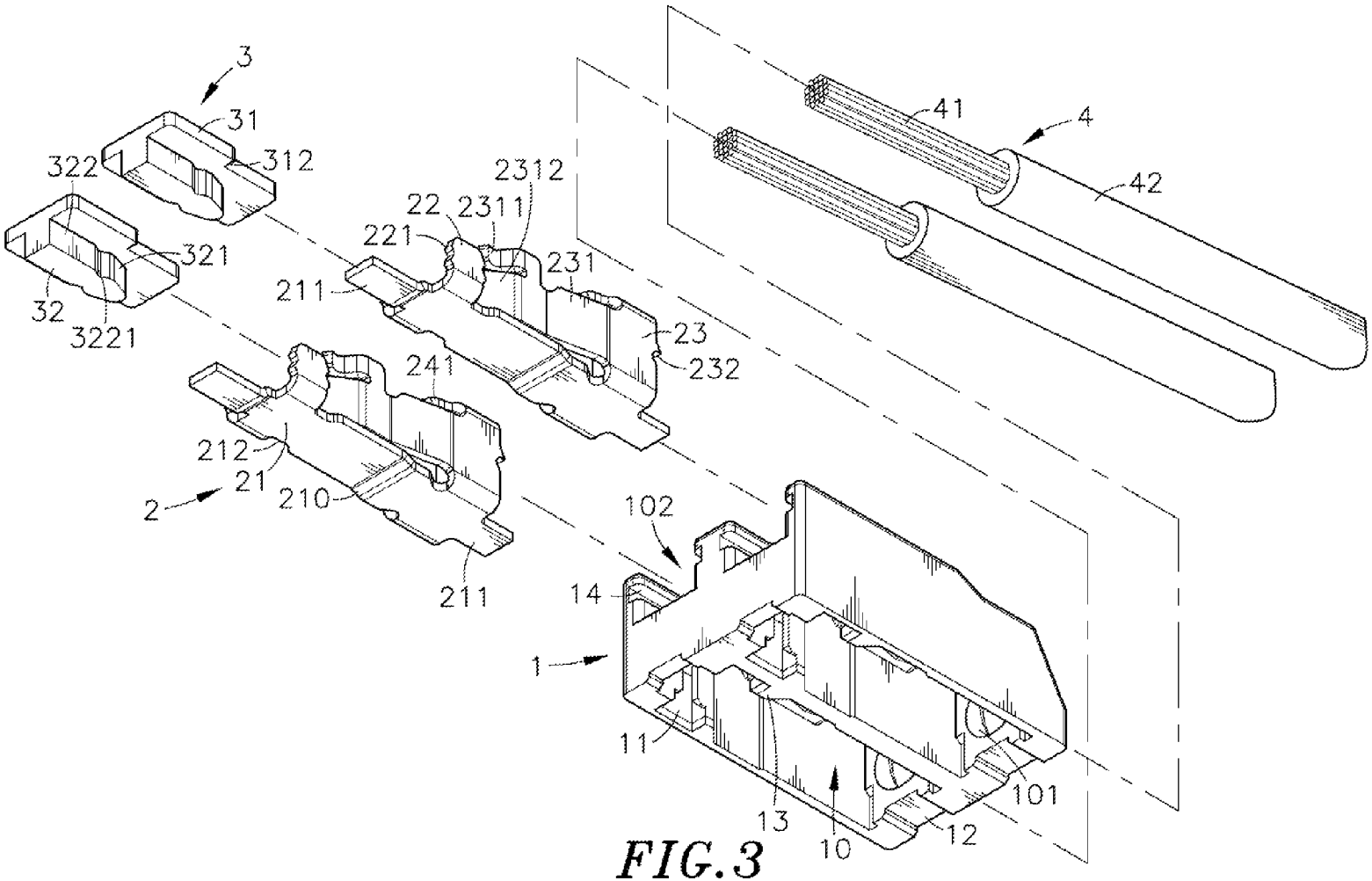
FIG. 3 corresponds to FIG. 2 when viewed from another angle.
Figure 4:
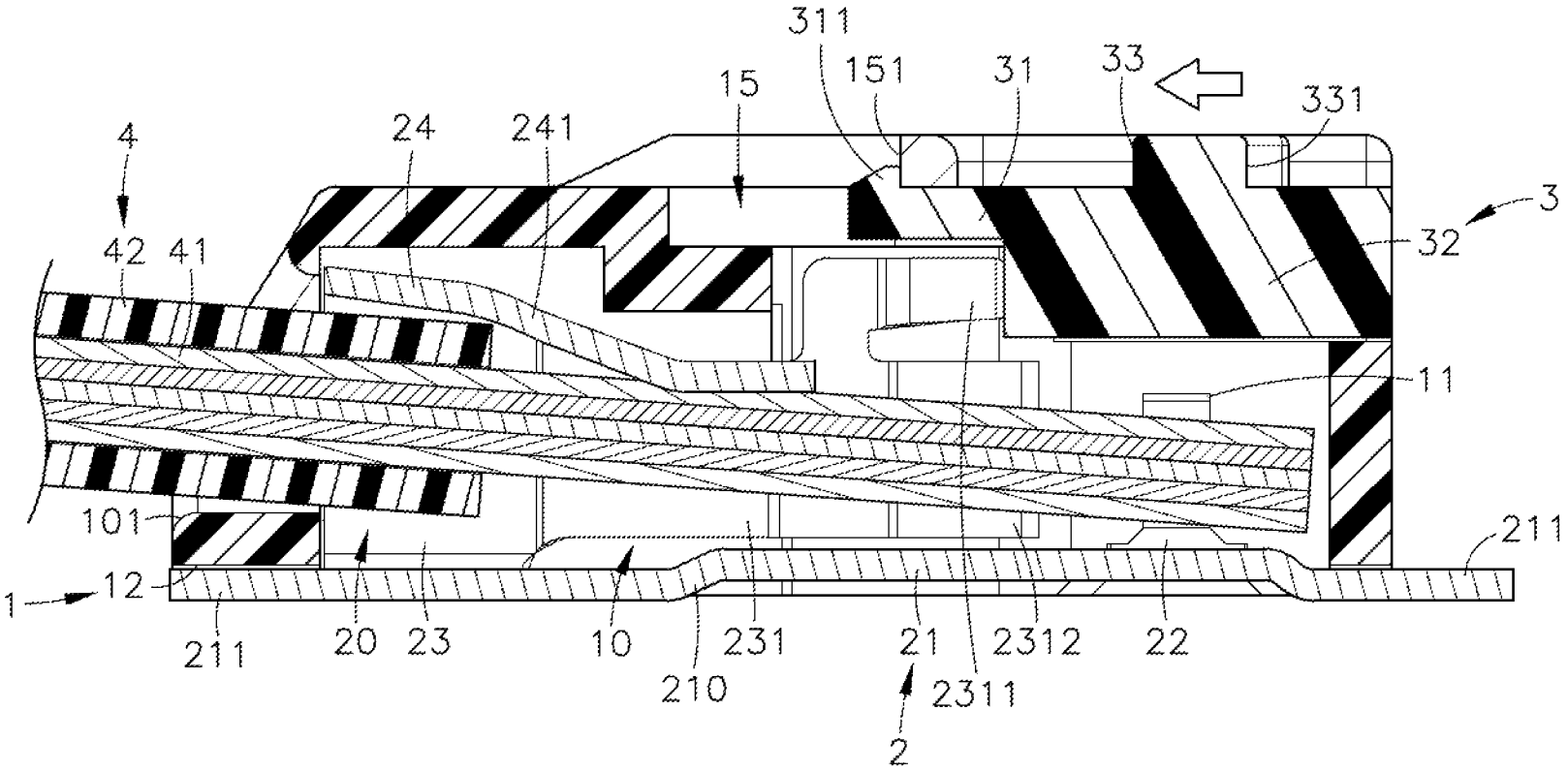
FIG. 4 is a sectional side view of the terminal connector in accordance with the present invention, illustrating the slide blocks disposed in the first position.

Referring to FIGS. 1-4, a terminal connector with improved actuation structure in accordance with the present invention is shown. The terminal connector comprises a housing 1, two conductor-retaining terminals 2 mounting in the housing 1 and respectively fastenable to a respective electrical wire 4, and two slide blocks 3 mounted in the housing 1 and respectively movable to cause change of the configurations of the respective conductor-retaining terminals 2 for securing or releasing the respective electrical wires 4.

The housing 1 comprises two accommodation chambers 10, two front openings 101 located in a front side thereof and respectively disposed in communication with the accommodation chambers 10, two horizontal sliding chambers 102 located in a top wall of an opposing rear side thereof and respectively disposed in communication with the accommodation chambers 10, two engagement holes 11 vertically located in a bottom side thereof and respectively disposed in communication with the horizontal sliding chambers 102, two locating grooves 12 located in a bottom side thereof in a parallel manner and respectively extended through the opposing front and rear sides thereof across the engagement holes 11, a plurality of horizontal retaining protrusions 13 respectively located at two opposite lateral sides in each engagement hole 11, two horizontal sliding grooves 14 bilaterally disposed in each horizontal sliding chamber 102, two elongated position-limit slots 15 located in an opposing top side thereof at a front side relative to the horizontal sliding chambers 102, and a vertical stop end edge 151 located at one end of each elongated position-limit slot 15 adjacent to the associating horizontal sliding chamber 102.

Each conductor-retaining terminal 2 comprises a base portion 21, an insertion passage 20 defined at a top side of the base portion 21 and extending through opposing front and rear sides thereof, a step 210 located at a middle part of a bottom wall of the base portion 21, a bonding portion 211 respectively extended from opposing front and rear ends of the base portion 21 in reversed directions in a flush manner, two engaging notches 212 symmetrically located at two opposite lateral sides of the base portion 21, two mounting pieces 22 respectively upwardly extended from the two opposite lateral sides of the base portion 21 between the rear bonding portion 211 and the engaging notches 212 and respectively defining a plurality of spurs 221, two side panels 23 respectively upwardly extended from the two opposite lateral sides of the base portion 21 adjacent to the front bonding portion 211, a springy suspension arm 231 backwardly inwardly extended from a rear side of each side panel 23, a shrapnel 2311 and a clamping portion 2312 extended from a distal end of each springy suspension arm 231 remote from the associating side panel 23 toward the insertion passage 20 at different elevations, a securing portion 232 protruded from an opposing front side of each side panel 23, and a top panel 24 perpendicularly extended from a top side of one side panel 23 and supported on a top side of the other side panel 23 over a top side of the insertion passage 20, and a pressing plate 241 backwardly and obliquely downwardly extended from a rear side of the top panel 24.

Each slide block 3 comprises a sliding cover panel 31 having a relatively narrower front half and a relatively wider rear half, a locating block 311 located at a front side of a top wall of the sliding cover panel 31, two stop edges 312 bilaterally defined between the relatively narrower front half and relatively wider rear half of the sliding cover panel 31, a push block 32 located at a middle part of an opposing bottom wall of the sliding cover panel 31, two beveled pushing surfaces 321 located at a front side of the push block 32, two planar surfaces 322 located on two opposite lateral sides of the push block 32 and respectively backwardly extended from the beveled pushing surfaces 321, two positioning grooves 3221 respectively located in the planar surfaces 322 adjacent to the beveled pushing surfaces 321, a protruding block 33 located at the top wall of the relatively wider rear half of the sliding cover panel 31, and a rear finger notch 331 located in a rear side of the protruding block 33.

Each electrical wire 4 comprises an axially extending inner conductor 41 and an outer insulation layer 42 surrounding the inner conductor 41. The inner conductor 41 can be made in the form of a conducting strip or conducting pin, or composed of a bundle of conducting wires.

Figure 5:
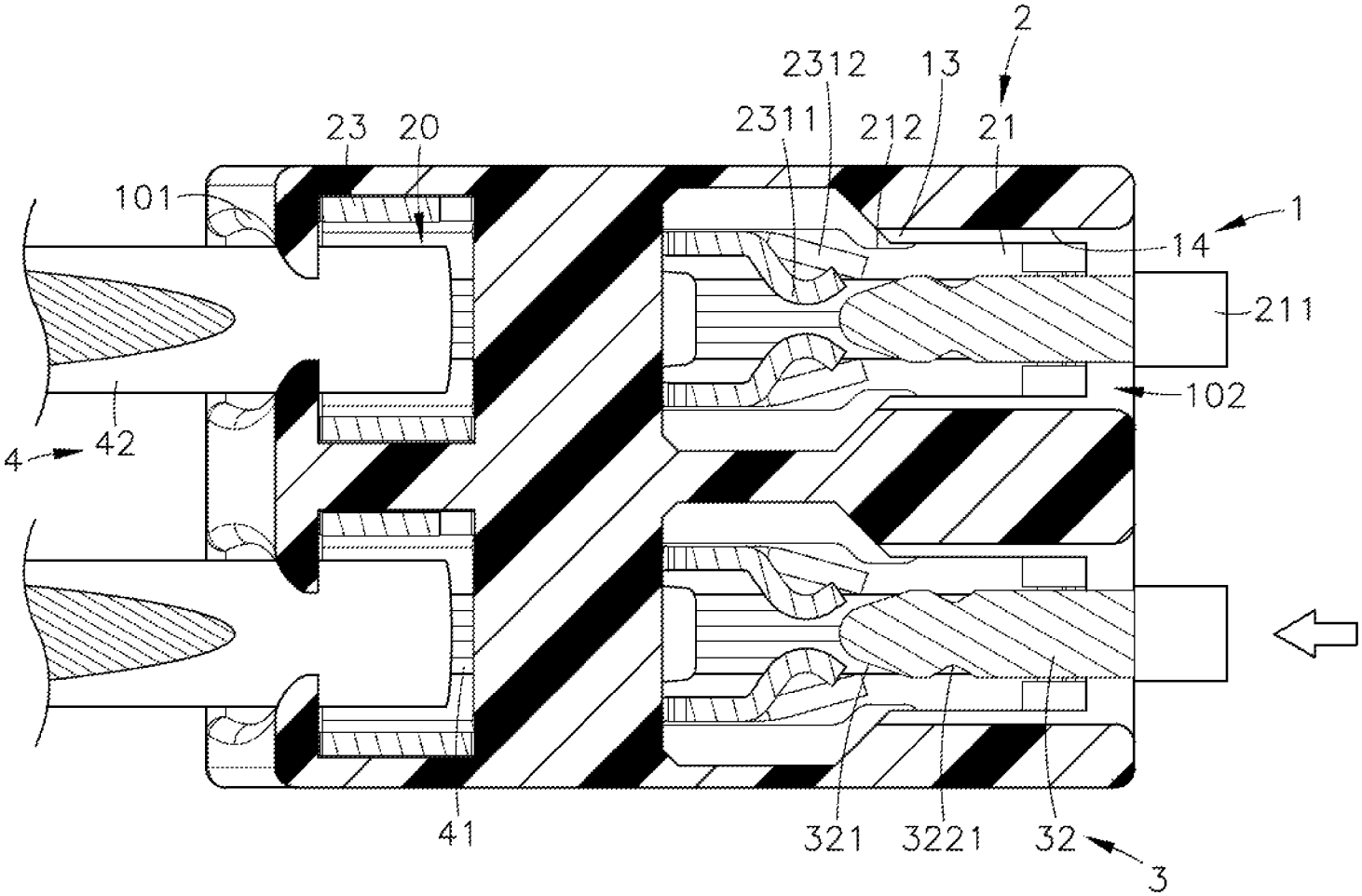
FIG. 5 is a sectional top view of the present invention, illustrating the slide blocks disposed in the first position and kept away from the springy clamping arms of the conductor-retaining terminals.
Figure 6:
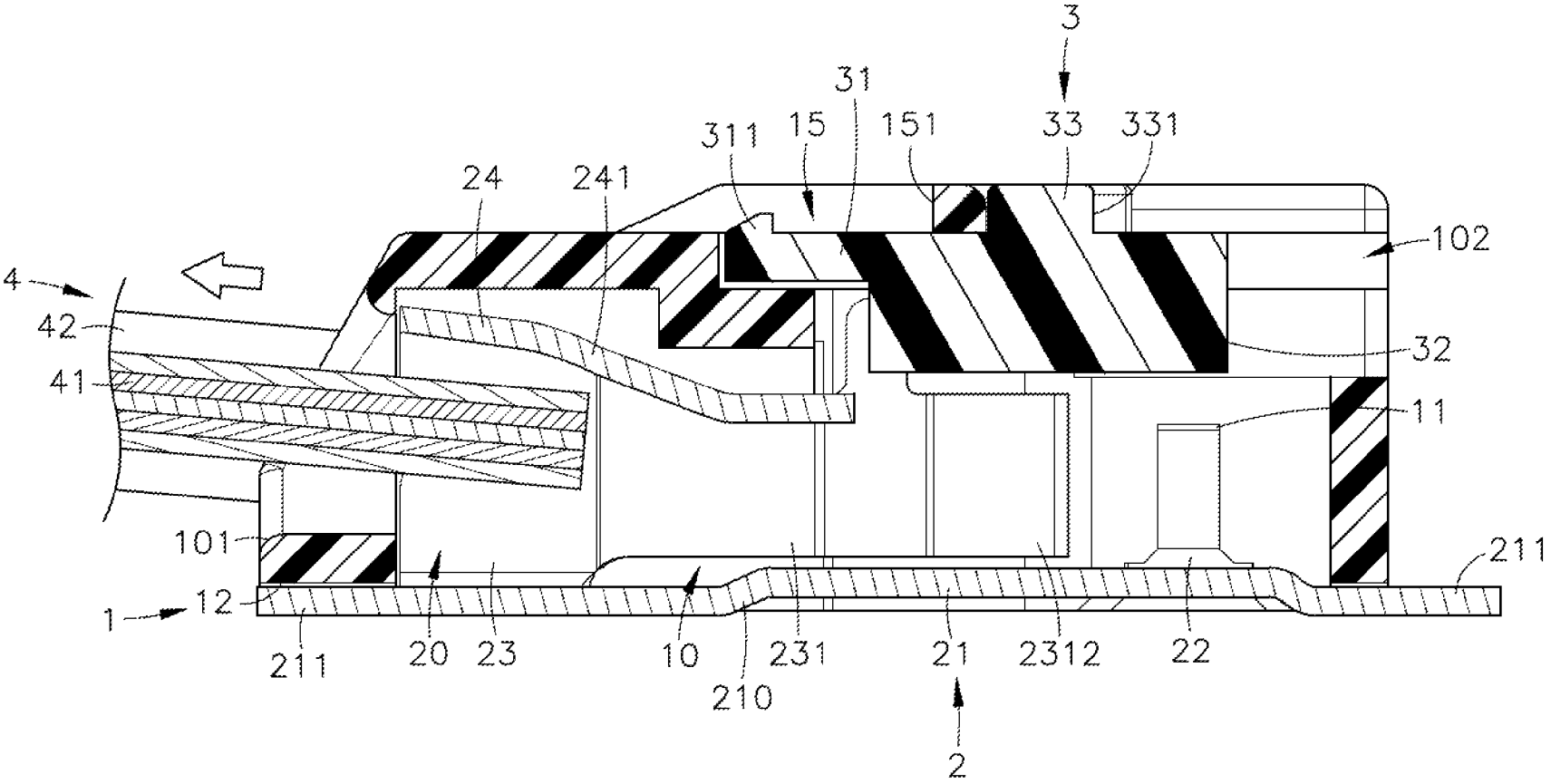
FIG. 6 corresponds to FIG. 4, illustrating the slide blocks moved to the first position.
Figure 7:
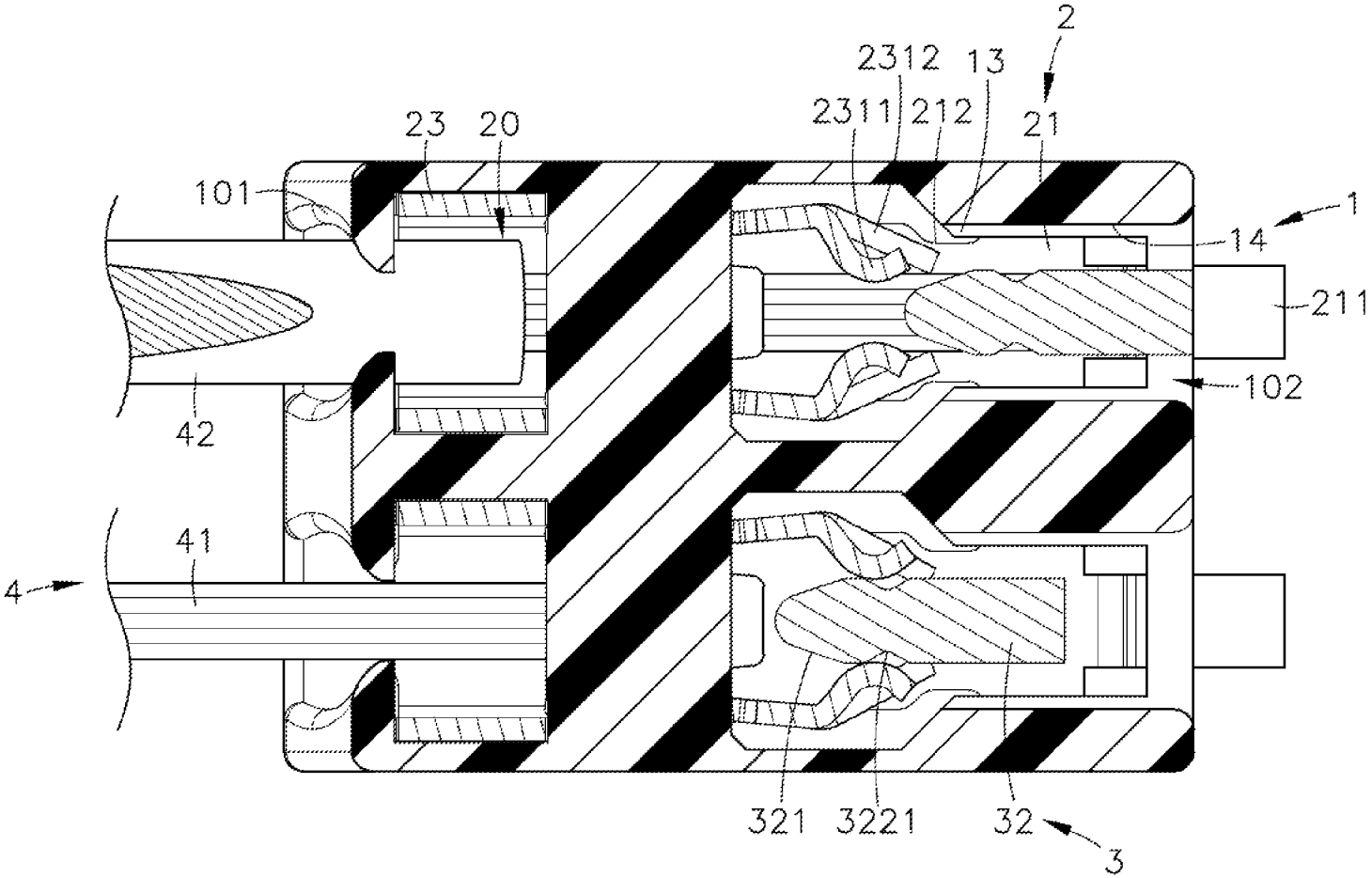
FIG. 7 corresponds to FIG. 5, illustrating one slide block moved to the second position.

Referring to FIGS. 5-7 and FIGS. 3 and 4 again, when assembling the terminal connector, respectively and upwardly insert the mounting pieces 22 of the conductor-retaining terminals 2 into the engagement holes 11 of the housing 1 to force the spurs 221 into friction engagement with the peripheral walls of the respective engagement holes 11 and the securing portions 232 of the side panels 23 of the conductor-retaining terminals 2 into friction engagement with the inside wall of the housing 1 around the front openings 101 and to simultaneously force the bonding portion 211 and the engaging notches 212 into engagement with the respective locating grooves 12 and the respective horizontal retaining protrusions 13, and then respectively horizontally insert the sliding cover panels 31 of the slide blocks 3 into the horizontal sliding grooves 14 in the horizontal sliding chambers 102 to move the respective locating blocks 311 along an inner top wall of the housing 1 into the respective elongated position-limit slots 15. After insertion of the sliding cover panels 31 of the slide blocks 3 into the horizontal sliding grooves 14 in the horizontal sliding chambers 102, the locating blocks 311 are respectively positioned in the elongated position-limit slots 15 and stopped at the respective vertical stop end edges 151 to prohibit the respective slide blocks 3 from escaping out of the respective horizontal sliding chambers 102.

After the terminal connector is assembled, the slide blocks 3 can be moved along the respective horizontal sliding grooves 14 in the respective horizontal sliding chambers 102 between a first position and a second position. When in the first position, the beveled pushing surfaces 321 of the push block 32 of each slide block 3 are aimed at and spaced away from the gap in between the two springy suspension arms 231 of the respective conductor-retaining terminal 2. At this time, the conductor-retaining terminal 2 is clamped on the inner conductor 41 of the respective electrical wire 4. In a first application mode, the inner conductor 41 of each electrical wire 4 is inserted through one respective front opening 101 into the insertion passage 20 of the respective conductor-retaining terminal 2 to push the pressing plate 241 and clamping portions 2312 of the respective conductor-retaining terminal 2 outwards and cause the pressing plate 241 and the clamping portions 2312 to deform elastically. After the inner conductor 41 of each electrical wire 4 has been inserted into position, the pressing plate 241 and clamping portions 2312 of each conductor-retaining terminal 2 are immediately forced by their elastic potential energy to return to their former shapes and to further clamp on the conductor 41 of the respective electrical wire 4, achieving multi-point contact between the conductor-retaining terminal 2 and the conductor 41 of the respective electrical wire 4. When wishing to remove the inner conductor 41 of each electrical wire 4 from the respective conductor-retaining terminal 2, attach one finger to the rear finger notch 331 at the protruding block 33 of the respective slide block 3 to move the respective slide block 3 in direction toward the respective position-limit slot 15, thereby moving the sliding cover panel 31 horizontally along the respective horizontal sliding grooves 14 to force the beveled pushing surfaces 321 into the gap in between the shrapnels 2311 of the springy suspension arms 231 of the respective conductor-retaining terminal 2 to the extent that the stop edges 312 of the sliding cover panel 31 are stopped at respective inner ends of the respective horizontal sliding grooves 14. At this time, the respective slide block 3 reaches the second position where the springy suspension arms 231 are respectively engaged into the positioning grooves 3221 at the planar surfaces 322, the shrapnels 2311 and clamping portions 2312 of the springy suspension arms 231 of the respective conductor-retaining terminal 2 are respectively and outwardly elastically deformed, allowing removal of the conductor 41 of the respective electrical wire 4 out of the respective front opening 101. Thus, when the slide blocks 3 are moved to the second position, the respective conductor-retaining terminals 2 are elastically deformed to release the conductors 41 of the respective electrical wires 4. In a second application mode of the present invention, horizontally move the sliding cover panel 31 of each slide block 3 along the respective horizontal sliding grooves 14 from the first position to the second position to force the beveled pushing surfaces 321 into the gap in between the shrapnels 2311 of the springy suspension arms 231 of the respective conductor-retaining terminal 2 to elastically deform the shrapnels 2311 and to let the springy suspension arms 231 be respectively engaged into the positioning grooves 3221 at the planar surfaces 322, and then insert the conductor 41 of each electrical wire 4 through one respective front opening 101 into the insertion passage 20 of the respective conductor-retaining terminal 2, and then move the sliding cover panel 31 of each slide block 3 from the second position to the first position to disengage the beveled pushing surfaces 321 out of the gap between the shrapnels 2311 of the respective conductor-retaining terminal 2, allowing the pressing plate 241 and the clamping portions 2312 to return to their former shapes subject to their elastic potential energy and to further clamp the conductor 41 of the respective electrical wire 4. When wishing to remove the conductor 41 of the respective electrical wire 4 out of the respective front opening 101 of the housing 1, move the sliding cover panel 31 of the respective slide block 3 from the first position to the second position to release the conductor 41 of the respective electrical wire 4 from the constraint, allowing removal of the conductor 41 of the respective electrical wire 4 out of the respective front opening 101 of the housing 1.

As stated above, the shrapnels 2311 and the clamping portions 2312 are respectively backwardly extended from the springy suspension arms 231 of the respective conductor-retaining terminals 2 at different elevations; the shrapnels 2311 and clamping portions 2312 of each conductor-retaining terminals 2 can be pushed to curve elastically outwardly by the beveled pushing surfaces 321 of the push block 32 of the respective slide block 3, thereby releasing the conductor 41 of the respective electrical wire 4 from the constraint of the clamping portions 2312 and allowing removal of the conductor 41 of the respective electrical wire 4 out of the respective front opening 101 of the housing 1. This design allows the user to move the push block 32 in curving the shrapnels 2311 and the clamping portions 2312 conveniently with less effort, and the shrapnels 2311, and thus, the clamping portions 2312 can be accurately pushed to release their clamping force from the conductor 41 of the respective electrical wire 4.

Figure 10:
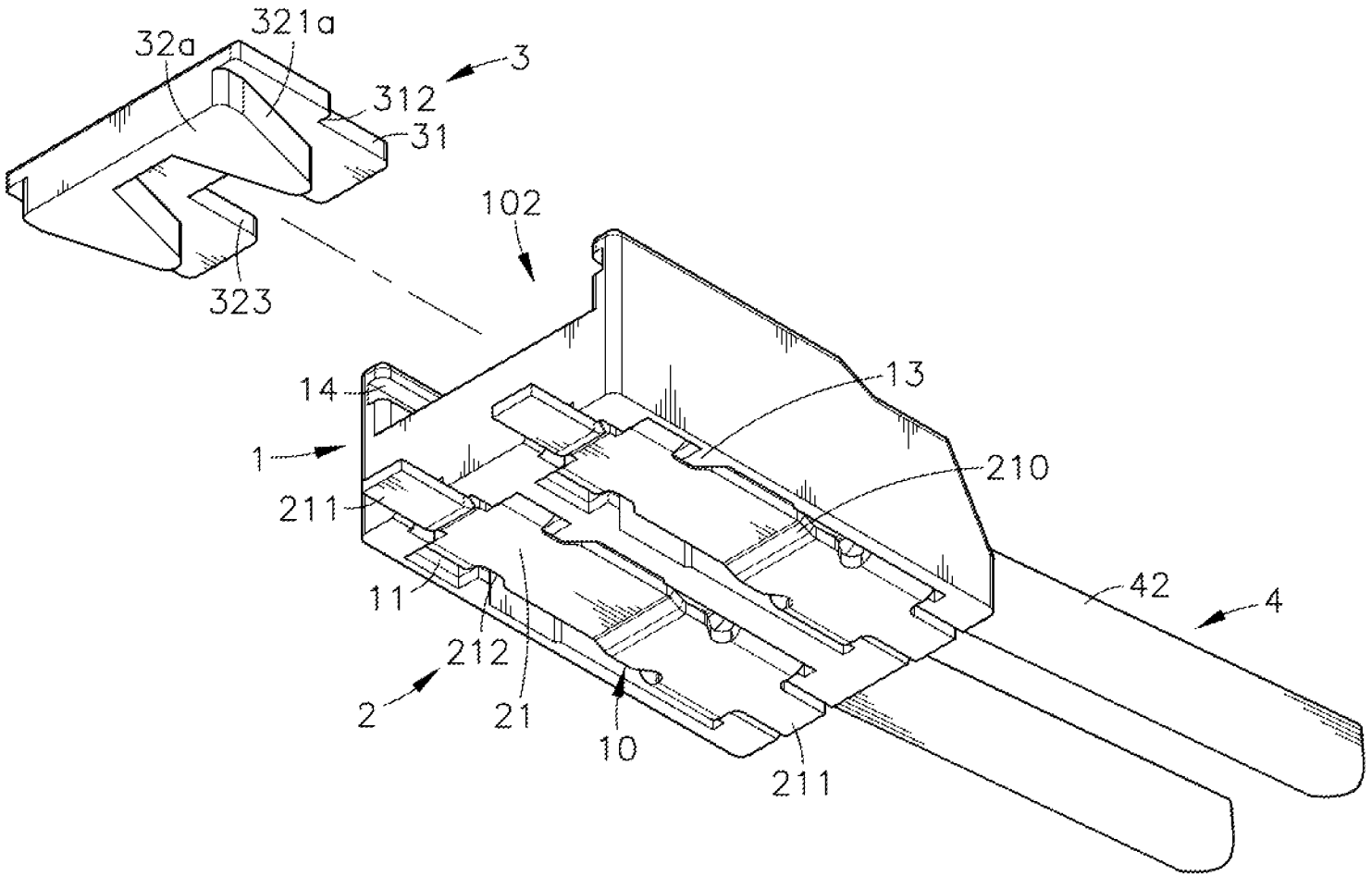
FIG. 10 is an exploded view of the present invention, illustrating another alternate form of the slide block.

Referring to FIG. 10 and FIG. 2 again, the sliding cover panels 31 of the two slide blocks 3 can be made in integrity with a locating notch 323 located on a middle part of the front side thereof for stopping against a rear middle part of the housing 1 between the two horizontal sliding chambers 102, i.e., one single slide block 3 of this design can be used for actuating the two conductor-retaining terminals 2.

Figure 8:
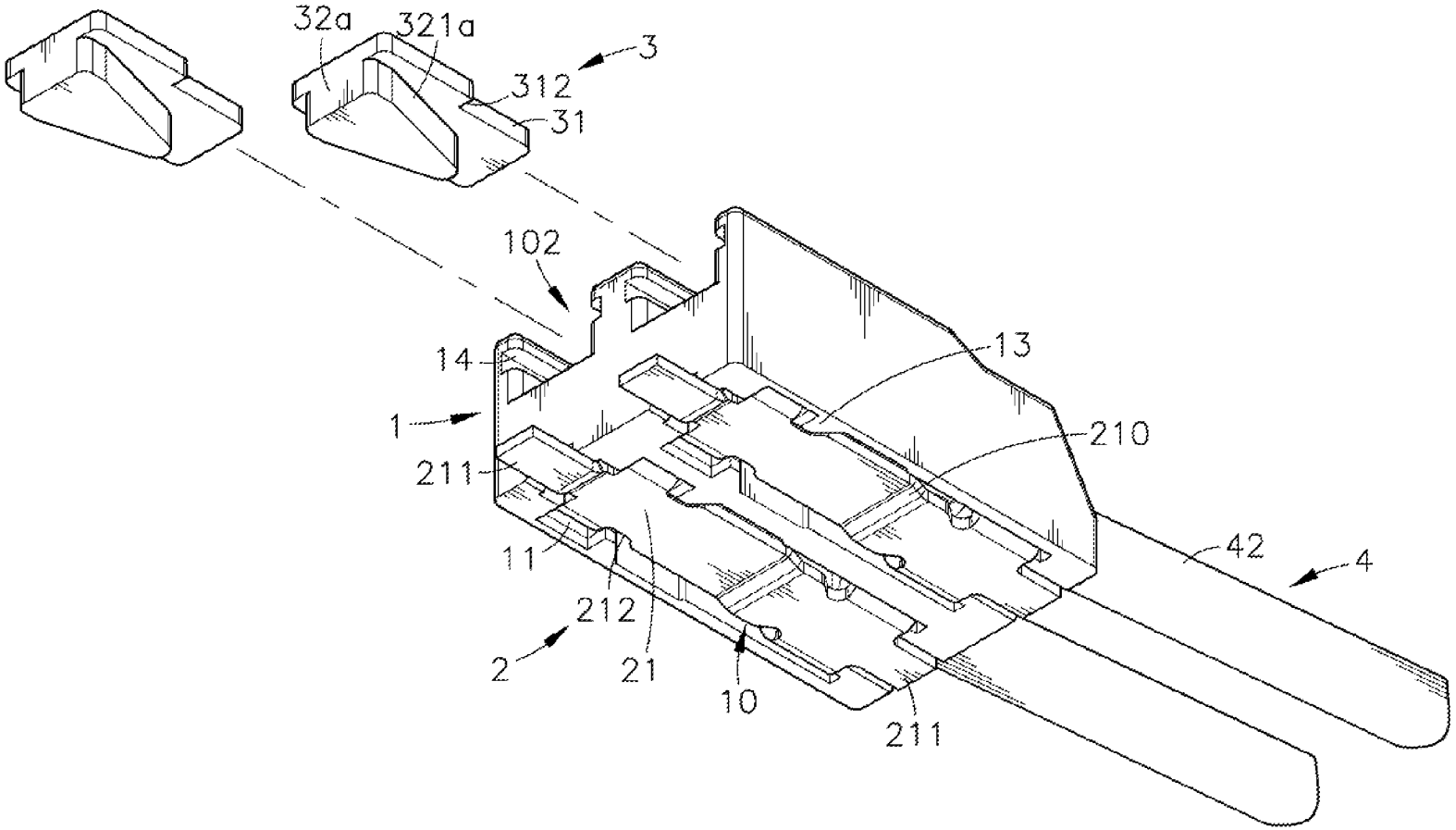
FIG. 8 is an exploded view of the present invention, illustrating an alternate form of the slide block.
Figure 9:
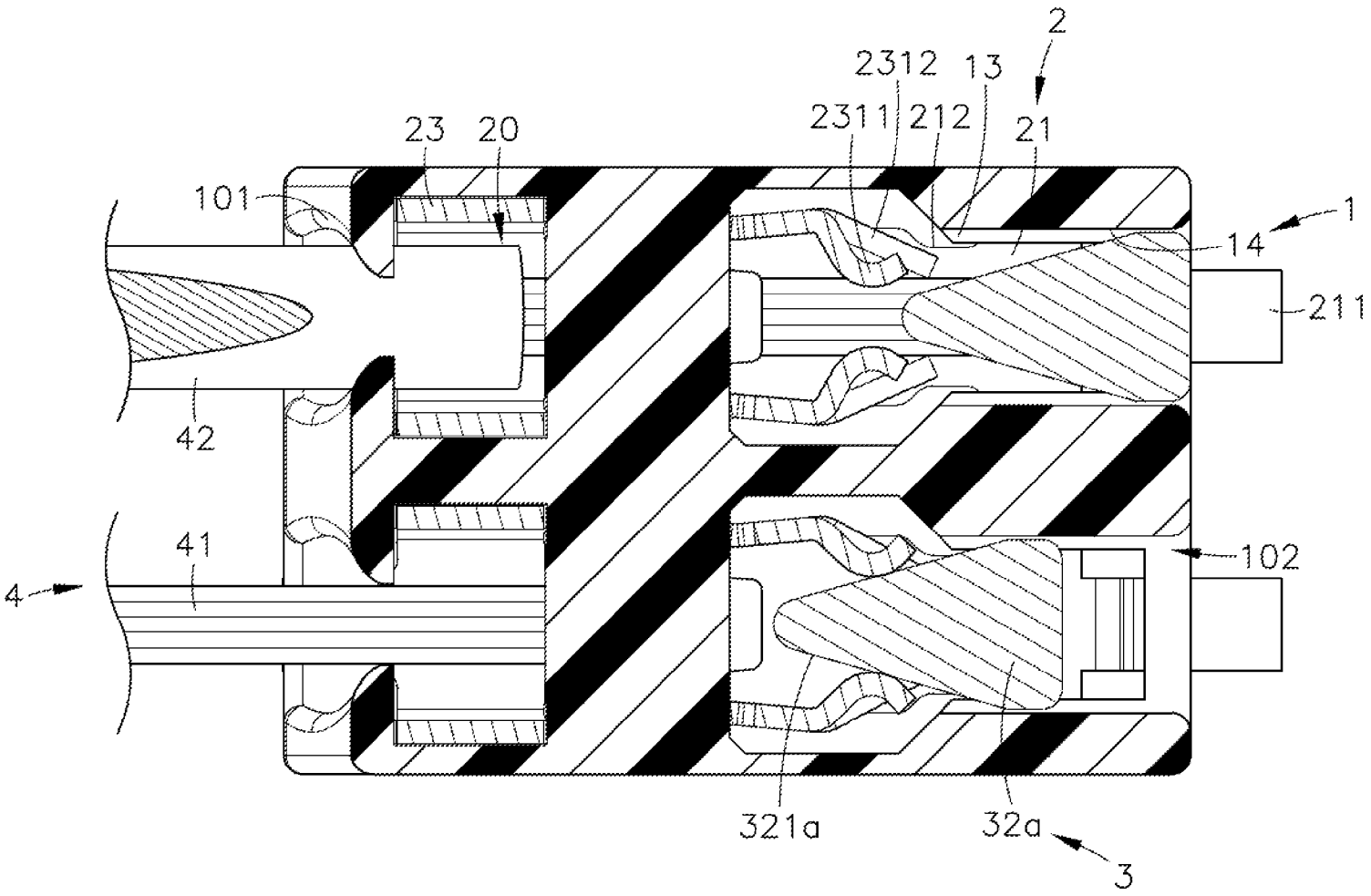
FIG. 9 corresponds to FIG. 7, illustrating the use of the alternate form of the slide blocks.

Referring to FIGS. 8 and 9 and FIG. 2 again, the push block, referenced by 32*a*, at the bottom side of the sliding cover panel 31 of each slide block 3 can be configured to provide only two beveled pushing surfaces 321*a* without the aforesaid planar surfaces 322. When in the first position, the two beveled pushing surfaces 321*a* are kept out of the gap in between the two springy suspension arms 231 of the respective conductor-retaining terminal 2. When the user pushes the slide block 3 from the first position to the second position, the user can hold the slide block 3 in position, and then insert the conductor 41 of one respective electrical wire 4 through one front opening 101 into the respective conductor-retaining terminal 2 or remove the respective electrical wire 4 out of the respective conductor-retaining terminal 2 and the housing 1. After insertion or removal of the electrical wire 4, the user can move the slide block 3 from the second position to the first position, or release the hand from the slide block 3, enabling the beveled pushing surface 321*a* to be pushed by hand or by the elastic potential energy of the springy suspension arms 231 of the conductor-retaining terminal 2 out of the gap between the two shrapnels 2311 to the outside of the conductor-retaining terminal 2.

Figure 11:
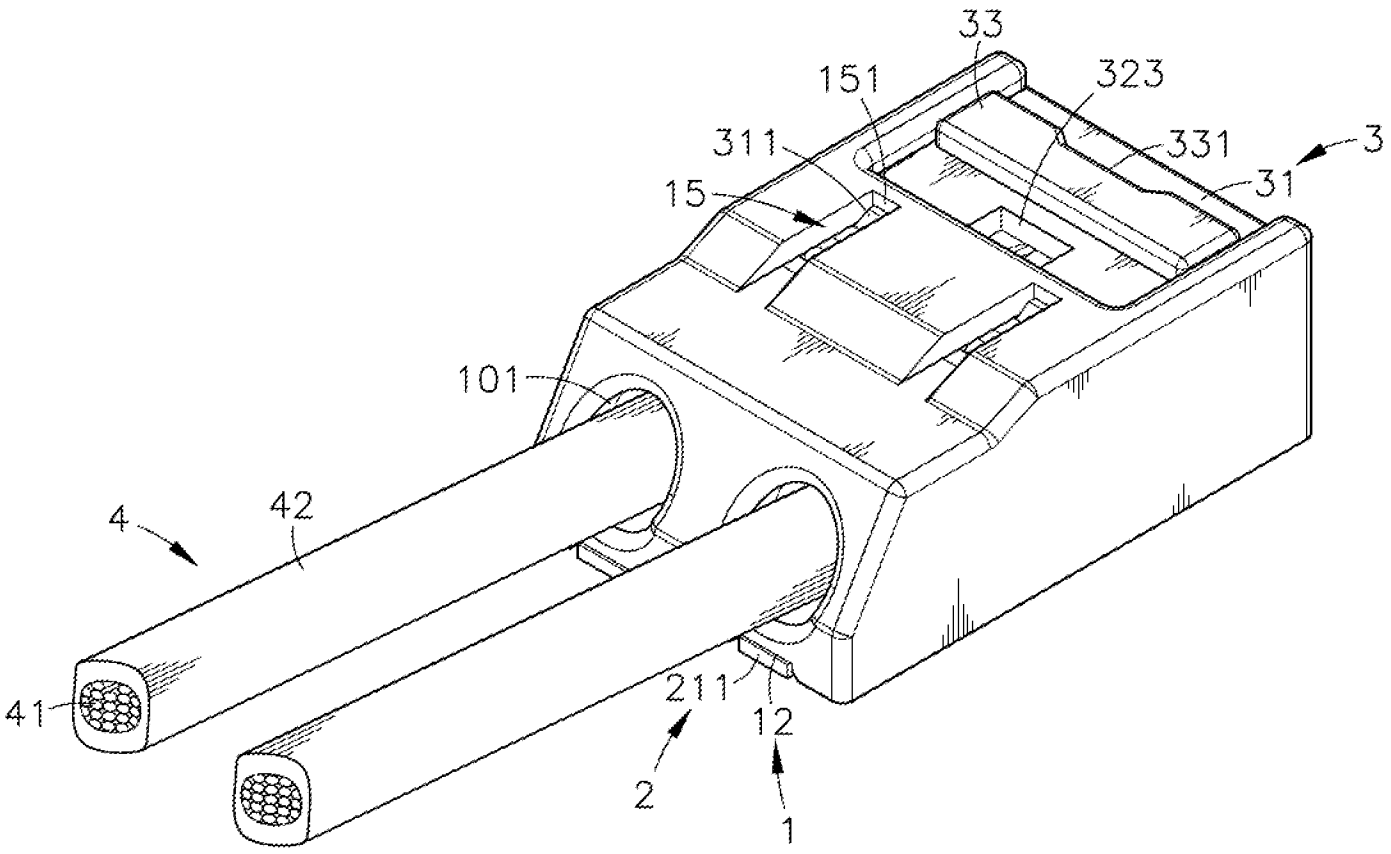
FIG. 11 is an oblique top elevational assembly view of FIG. 10.
Figure 12:
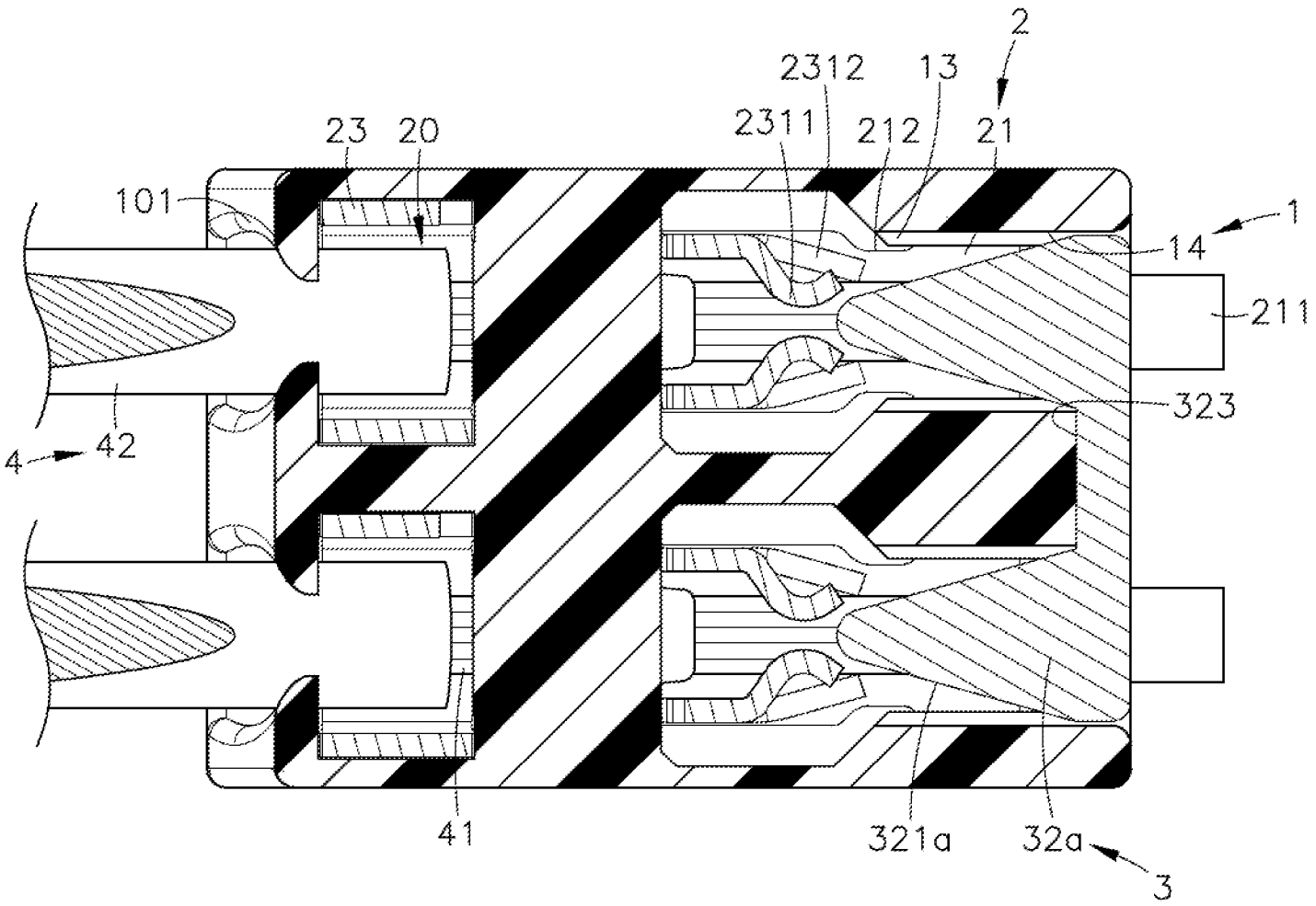
FIG. 12 is a sectional top view of FIG. 11.

Referring to FIGS. 11 and 12 and FIGS. 2 and 10 again, each of the two push blocks 32*a* of the slide block 3 defines only one beveled pushing surface 321*a* at an outer side; the housing 1 is configured to provide one single horizontal sliding chamber 102 and two horizontal sliding grooves 14 at two opposite lateral sides of the horizontal sliding chamber 102 for receiving the sliding cover panel 31 of the slide block 3, allowing the slide block 3 to be moved horizontally relative to the housing 1 between the first position and the second position.

In the aforesaid embodiments, the housing 1 comprises two accommodation chambers 10 for accommodating the two conductor-retaining terminals 2, and two horizontal sliding chambers 102 for the mounting of the two slide blocks 3. However, in actual application, the housing 1 can be configured to provide at least one accommodation chamber 10 for accommodating at least one conductor-retaining terminal 2 and at least one horizontal sliding chamber 102 for the mounting of at least one slide block 3.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A terminal connector, comprising:

a housing comprising at least one front opening located in a front side thereof, at least one horizontal sliding chamber located in a top wall of an opposing rear side thereof, and an accommodation chamber defined therein in communication between said at least one front opening and said at least one horizontal sliding chamber;

at least one conductor-retaining terminal mounted in said accommodation chamber of said housing, each said conductor-retaining terminal comprising a base portion, an insertion passage defined at a top side of said base portion and aimed at one said front opening of said housing, a bonding portion extended from opposing front and rear sides of said base portion, two side panels respectively upwardly extended from two opposite lateral sides of said base portion adjacent to said front bonding portion, and a springy suspension arm backwardly inwardly extended from a rear side of each side panel; and at least one slide block respectively mounted in said at least one horizontal sliding chamber of said housing, each said slide block comprising a sliding cover panel and a push block located at a middle part of a bottom wall of said sliding cover panel, said push block defining two beveled pushing surfaces at a front side thereof, each said slide block being slidable relative to said housing between a first position where said two beveled pushing surfaces of each said slide block are kept away from the gap in between said two springy suspension arms of the respective said conductor-retaining terminal, and said springy suspension arms of each said conductor-retaining terminal are clamped on a conductor of a respective electrical wire, and a second position where said beveled pushing surfaces of each said slide block are inserted into the gap in between the two said springy suspension arm, the two said springy suspension arms are respectively and outwardly elastically deformed to release the conductor of the respective clamped electrical wire from the constraint of the respective said springy suspension arms for allowing removal of the conductor of the respective clamped electrical wire out of the respective said front opening of said housing.

2. The terminal connector as claimed in claim 1, wherein each said conductor-retaining terminal further comprises a shrapnel and clamping portion respectively backwardly extended from each said springy suspension arm at different elevations and respectively inwardly curved toward said insertion passage of the respective said conductor-retaining terminal, said shrapnel being elastically deformable by said beveled pushing surfaces of the respective said slide block, said clamping portions being adapted for clamping on the conductor of one respective said electrical wire.

3. The terminal connector as claimed in claim 1, wherein said housing further comprises two horizontal sliding grooves bilaterally located in each said horizontal sliding chamber; said sliding cover panel of each slide block is slidably coupled to said two horizontal sliding grooves in one respective said horizontal sliding chamber.

4. The terminal connector as claimed in claim 3, wherein said housing further comprises at least one elongated position-limit slots located in a top side thereof and disposed at a front side relative to said horizontal sliding chambers; each said slide block further comprises a locating block located at a top front side of the sliding cover panel thereof and positioned in one respective said elongated position-limit slot of said housing.

5. The terminal connector as claimed in claim 3, wherein said sliding cover panel of each said slide block comprises a relatively narrower front half and a relatively wider rear half, and two stop edges bilaterally defined between said relatively narrower front half and said relatively wider rear half.

6. The terminal connector as claimed in claim 1, wherein said push block of each said slide block comprises two planar surfaces respectively located at two opposite lateral sides thereof and respectively backwardly extended from said beveled pushing surface, and a positioning groove located in each said planar surface.

7. The terminal connector as claimed in claim 1, wherein said housing further comprises two locating grooves located in a bottom side thereof in a parallel manner and respectively extended through the opposing front and rear sides thereof; each said conductor-retaining terminal comprises said bonding portion respectively extended from opposing front and rear ends thereof and positioned in one of said locating grooves of said housing.

8. The terminal connector as claimed in claim 1, wherein each said conductor-retaining terminal comprises a securing portion protruded from an opposing front side of each side panel.

9. The terminal connector as claimed in claim 1, wherein each said conductor-retaining terminal further comprises a top panel perpendicularly extended from a top side of one side panel thereof and supported on a top side of the other side panel thereof.

10. The terminal connector as claimed in claim 9, wherein each said conductor-retaining terminal further comprises a pressing plate obliquely downwardly extended from a rear side of the top panel.

* * * * *